United States Patent [19]

Rhines

[11] Patent Number: 5,052,325

[45] Date of Patent: Oct. 1, 1991

[54] SWIVEL CHAIR STAND AND TROLLING MOTOR CONTROL

[76] Inventor: Michael Rhines, P.O. Box 1464, Orange, Tex. 77630

[21] Appl. No.: 422,402

[22] Filed: Oct. 16, 1989

[51] Int. Cl.[5] ..... B63B 29/00; B63H 21/26

[52] U.S. Cl. ..... 114/363; 297/192; 297/349; 440/6; 440/62; 440/63

[58] Field of Search ..... 114/363; 440/6, 7, 62, 440/63; 384/486; 297/192, 349

[56] References Cited

U.S. PATENT DOCUMENTS

| | | | |
|---|---|---|---|
| 1,903,217 | 3/1933 | Hodge | 384/486 |
| 3,559,612 | 2/1971 | Patterson | 440/62 |
| 3,606,858 | 9/1971 | Edwards et al. | 440/7 |
| 4,008,500 | 2/1977 | Hall, Jr. | 440/7 X |
| 4,790,432 | 12/1988 | Rees | 297/192 X |

*Primary Examiner*—Sherman Basinger
*Attorney, Agent, or Firm*—Kenneth D. Baugh

[57] ABSTRACT

A swivel chair stand 11 and trolling motor control assembly 60 are provided for use by an occupant to control a trolling motor 62 mounted on a bow of a boat 12. The trolling motor control assembly 60 includes a support bracket 66 which is coupled adjacent to a seat 24. An elongated control arm 92 is pivotably mounted on the support bracket 66for diagonal movement thereon. When the arm is moved in desired diagonal directions a trolling motor control cable 116 engages the trolling motor to move the motor in lateral directions corresponding to the diagonal movement of the control arm. This in turn facilitates movement of the boat 12.

5 Claims, 3 Drawing Sheets

SWIVEL CHAIR STAND AND TROLLING MOTOR CONTROL

TECHNICAL FIELD

This invention relates to fishing and more particularly to a fishing swivel, chair stand and trolling motor control to be used by fisherman.

It goes without saying that fishing is a very popular sport.

Because it is so popular there is a continuing effort to make the endeavor more comfortable thus more enjoyable. One thing that makes the endeavor more comfortable is the ability to sit as desired. When fishing from a boat, particularly when bass fishing, a fisherman often uses a trolling motor to guide the boat in the water as desired. This often means having access to a seat which is close to or associated with the trolling motor and its control. When such seats are provided these seats often have foot controls for the trolling motor. Thus although the fisherman is sitting he is in all likelyhood going to be faced with having to engage in quite alot of foot and leg movement to control the motor. Obviously this can lead to fatigue. For some fisherman who might prefer other arrangements a hand controlled motor would be preferable.

BACKGROUND ART

When fishing with and using the trolling motor a fisherman has no choice but to stand unless a fishing stool or chair is available and in close proximity with the trolling motor. There are a number of different such arrangements in existence today. However these arrangements are devices that must be operated by the fisherman's foot or by the involvement of the fisherman's feet and other portions of the body.

One such arrangement is disclosed in U.S. Pat. No. 4,722,706. This arrangement is one where the trolling motor is activated from a foot pedal. Specifically it relates to a roller base for supporting the foot pedal which in turn is used to control the operation of trolling motor. Another arrangement is disclosed in U.S. Pat. No. 4,645,462. In this arrangement a steering apparatus for a trolling motor is provided. The apparatus includes a rotable pedestal below the seat which supports a boat occupant. The rotable pedestal controls the motor as rotated by the seat occupant. In both these patents motor control depends on either the feet, legs and or other portions of the body of the user.

Accordingly it is desirable to provide a device that will allow a fisherman to control the trolling motor while using portions of the body, that would be considered by many to be more comfortable. That is the hand and arm.

DISCLOSURE OF THE INVENTION

A trolling motor assembly is provided for controlling the movement of a trolling motor which is mounted on a boat. The trolling motor assembly is provided with a platform support member having an opening formed therein. A seat is coupled to a upper portion of the platform support member. The trolling motor assembly also includes a means coupled to a lower portion of the platform support member for supporting the platform support member and seat in an upright position on the boat in alignment with and adjacent to the trolling motor. A support bracket is provided which is coupled to the seat adjacent to one side of the platform support member and seat. Another means is pivotably coupled to the support bracket for diagonal movement thereon. Accordingly when this means is moved diagonally in one direction the trolling motor is moved laterally in a first direction and when the means is moved diagonally in another direction the trolling motor is moved laterally in a second direction.

BRIEF DESCRIPTION OF THE DRAWING

The details of the invention will be described in connection with the accompanying drawing in which.

BEST MODE FOR CARRYING OUT THE INVENTION

Figure 1:
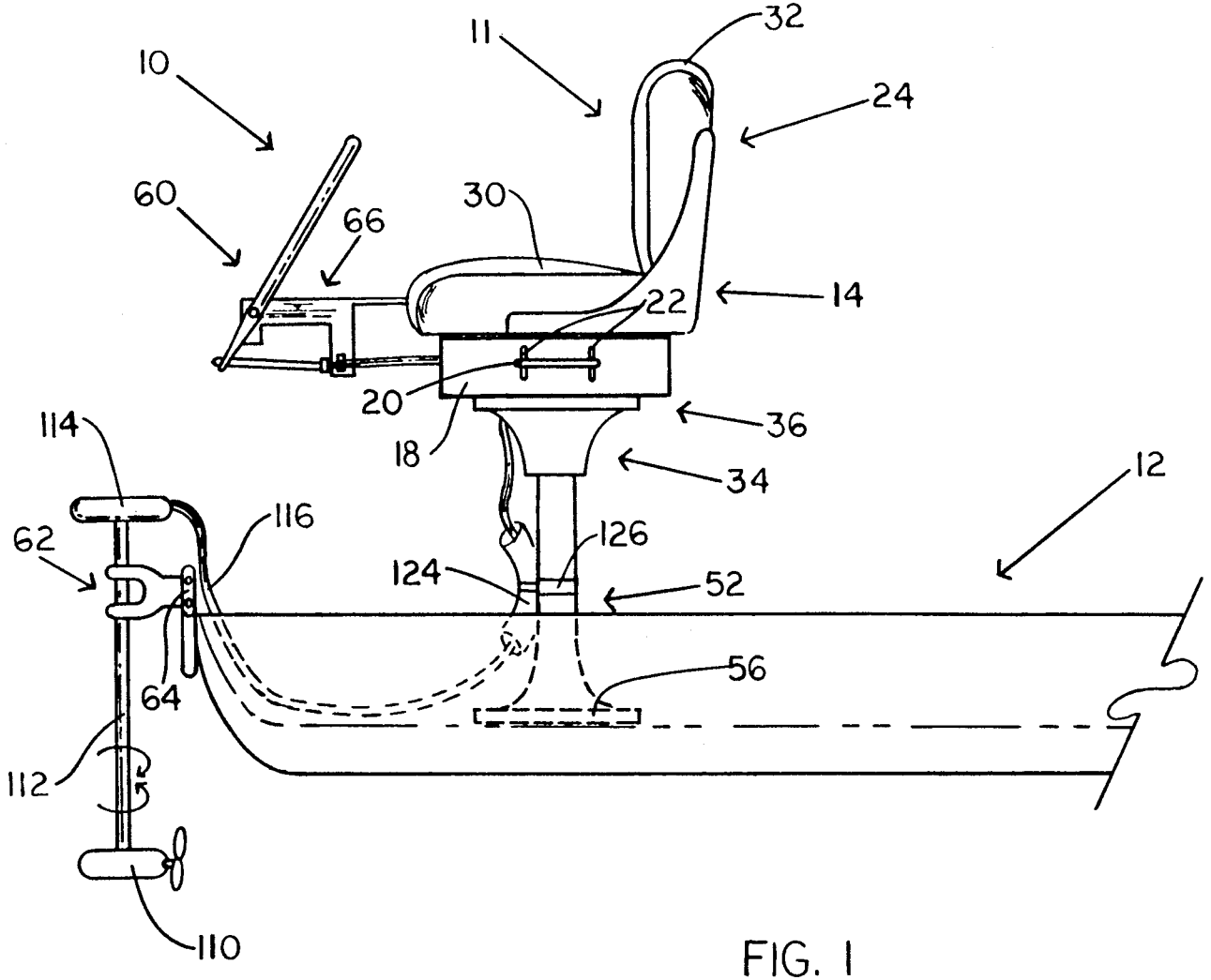
FIG. 1 is an elevation view of the Swivel Chair stand and trolling motor control when mounted on a bow of a boat in accordance with the principals of the invention.
Figure 2:
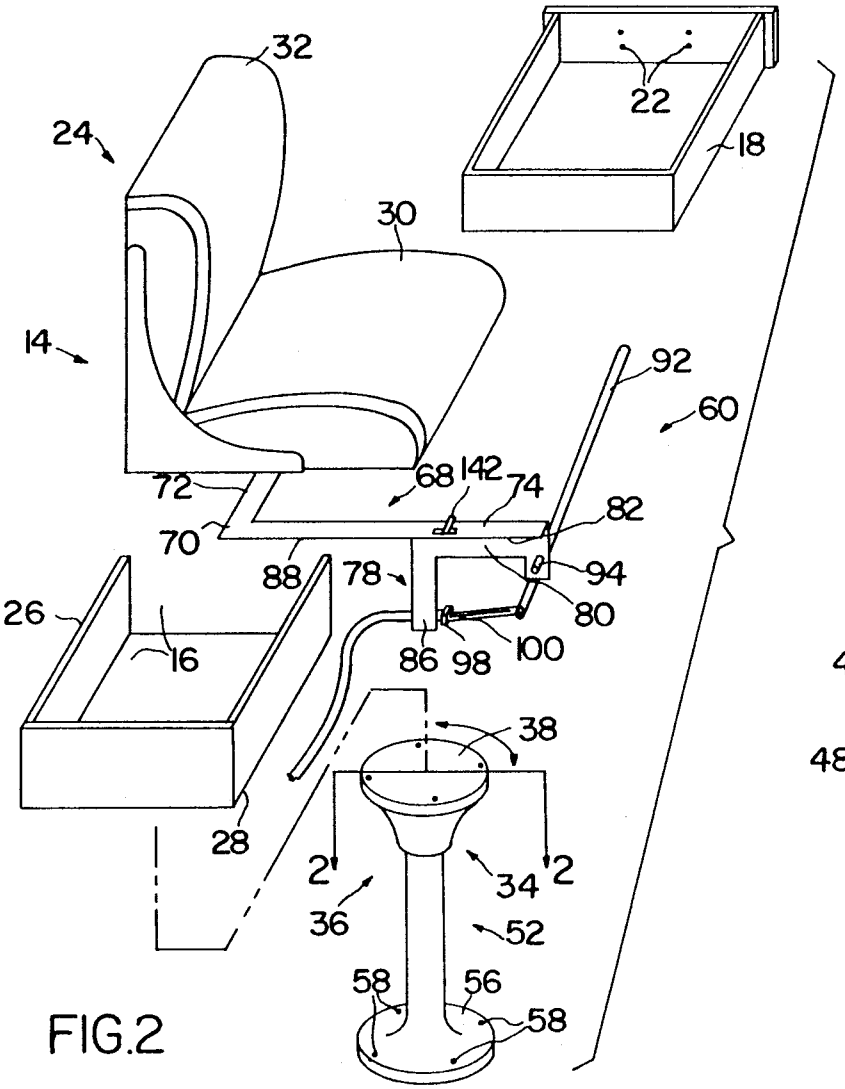
FIG. 2 is an exploded view of the swivel chair stand and trolling motor control in accordance with the principals of the invention.

As illustrated in FIGS. 1 and 2, a swivel chair stand and trolling motor control, generally designated, by the numeral, 10 is provided. The swivel chair stand and trolling motor control includes a swivel chair stand, generally designated by the numeral 11, which is provided to support an occupant (not shown) on a bass boat 12 while fishing. The swivel chair stand 11 includes a platform support member, generally designated, by the numeral, 14. The platform support member 14 is provided with a hollow portion 16 (FIG. 2) formed in an intermediate portion thereof.

The platform support member 12 is provided with a storage compartment or drawer 18 which is slidably mounted in the hollow portion 16 of the support member. The storage compartment 18 is provided for storing fishing accessories such as, for example, hooks and lures. These are articles that a fisherman would normally keep in a fishing tackle box. Manual manipulation of and access to the storage compartment 18 is provided by a handle 20 which is mounted on the storage compartment 18 by screws 22.

The platform support member 14, has a chair or seat, generally designated, by the numeral 24 coupled to an upper surface 26 thereof. The seat 24 includes a lower seat support 30 and a back support member 32 coupled to the seat support.

Figure 3:
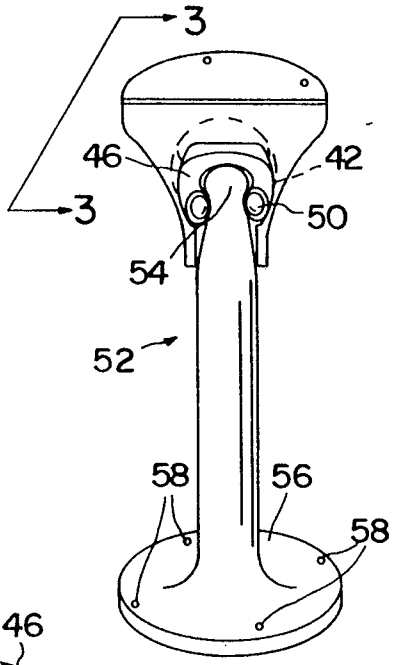
FIG. 3 is a cross-sectional view taken along lines 2—2 in FIG. 2.
Figure 4:
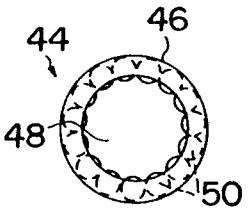
FIG. 4 is a cross-sectional view taken along lines 3—3 in FIG. 3.

A pedestal assembly, generally designated, by the numeral, 34 (FIG. 2) is provided to support the platform support member 14 and seat 24. The pedestal assembly 34 includes a swivel assembly, generally designated, by the numeral, 36 ( FIG. 3) for permitting the platform support member 14 and seat 24 to be rotated. The swivel assembly 36 is provided with a swivel support member, generally designated, by the numeral 38. The swivel support member 38 is coupled to the platform support member 14 on a bottom surface 28 thereof by a pair of bolts 40 (FIG. 2). The swivel support member 38 is provided with a tapered opening 42 formed therein. A ball bearing assembly 44 (FIG. 4) is mounted in the swivel support member 38 in an upper portion of the opening 42. The upper portion of the opening 42 is designed to hold the ball bearing assembly snugly therein. The ball bearing assembly 44 includes a circular sleeve 46, having an opening 48 formed therein and a plurality of ball bearings 50 coupled for rotation in the sleeve.

The pedestal assembly 34 also includes an upstanding member, generally designated, by the numeral 52. An upper portion 54 of the upstanding member 52 (FIG. 3) is forced fit in the opening 42 of the swivel support member 38 and the opening 48 of the ball bearing assembly 44. This allows the swivel support member 38 to rotate on the upstanding member thereby permitting rotation of the platform support member 14 and seat 24. The pedestal assembly 34 also includes a base supporting member 56 which is coupled to the boat 12 by bolts 58.

The swivel chair stand and trolling motor control 10 also includes a trolling motor control assembly, generally designated, by the numeral 60. The trolling motor control assembly is coupled to the seat 24 between the platform support member 14 and the seat member 30 adjacent one side of the seat. The trolling motor control assembly 60 is provided to control the operation of a trolling motor, generally designated, by the numeral 62. The trolling motor 62 is mounted on the bow of the boat 12 by a mounting bracket 64 in a well known manner.

Figure 5:
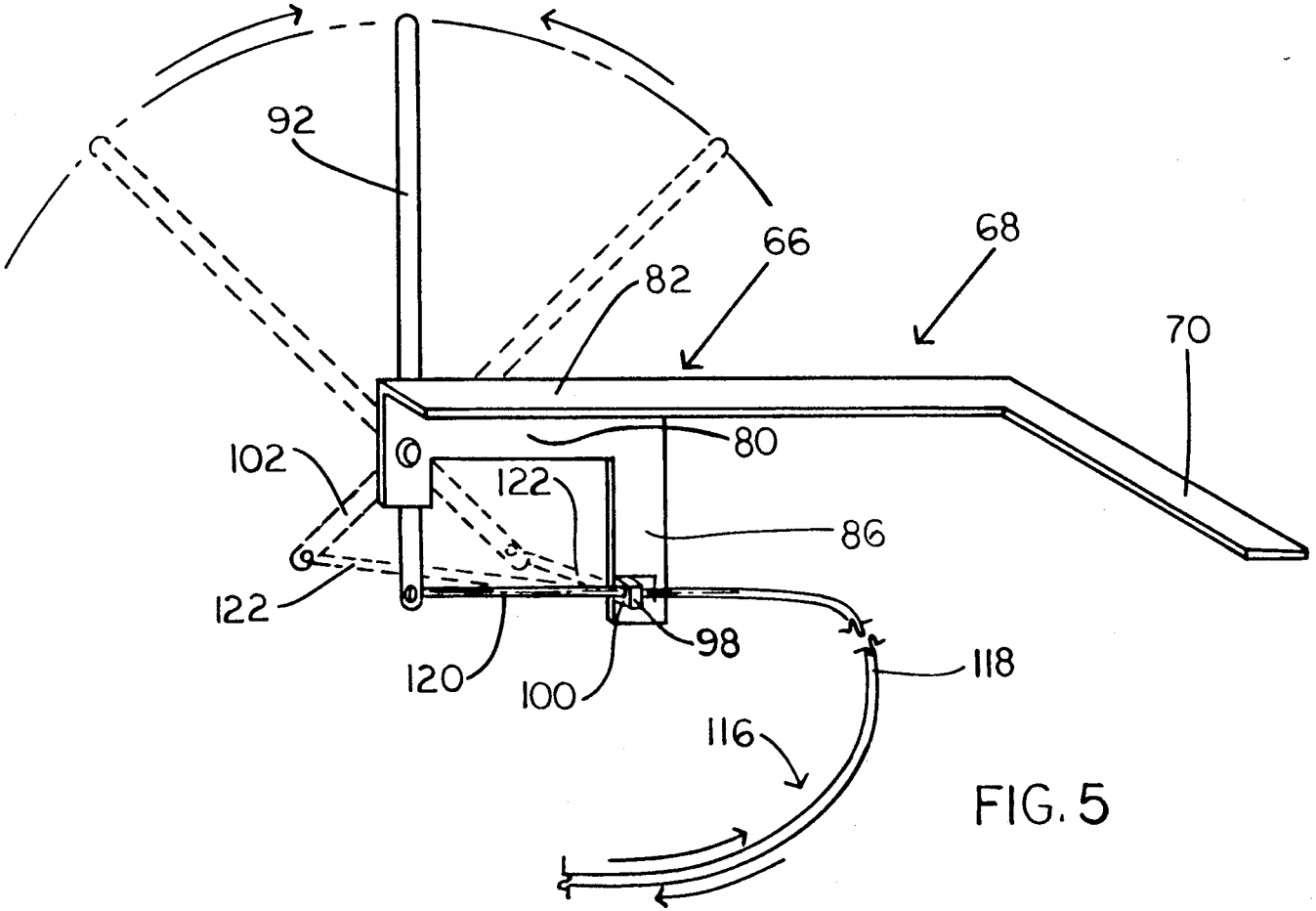
FIG. 5 is a perspective view of portions of the trolling motor control assembly in accordance with the principals of the invention.

The trolling motor control assembly 60 is provided with a support bracket, generally designated, by the numeral, 66 (FIG. 5). The support bracket 66 includes an L-shaped member, generally designated, by the numeral 68, having a laterally extending arm 70 with lower portions 72 thereof coupled to the seat member 30 adjacent one side of the platform support member 14 and the seat 24. The L-shaped member 68 also includes a longitudinally extending arm 74 which is coupled to extend perpendicularly from the laterally extending arm 70.

The support bracket 66 also includes a second L-shaped member generally, designated by, the numeral, 78. The L-shaped member 78 has a longitudinally extending arm 80 having upper portions 82 thereof coupled to the longitudinally extending arm 74 of the L-shaped member 68. The L-shaped member 78 also includes a downwardly projecting arm 86 which extends perpendicularly from the longitudinally extending arm 80.

The trolling motor control assembly 60 is also provided with an elongated control arm 92. The control arm 92 is pivotably coupled to the longitudinally extending arm 80 of the L-shaped member 78 by a bolt 94. The control arm 92 is pivotably mounted to move diagonally in a clockwise and counter clockwise direction as indicated in phantom in (FIG. 5).

A planar support member 98, having an aperture 100 formed therein, is coupled to extend perpendicularly from a lowermost side of the downwardly projecting arm 86 of the L-shaped member 78.

The trolling motor 62 is provided with a Power unit 110 which is supported by a shaft 112 at the bow of the boat 12. A steering mechanism 114 is coupled to the top of the shaft 112 to rotate the shaft, in accordance with the positioning of a cable 116, connected thereto.

The cable 116 (FIG. 5) is a commonly used control cable having an outer sleeve 118 and an inner wire-like member 120. The cable 116 is coupled to an end 102 of the control arm 92 at an end 122 thereof (FIG. 5), and succeeding portions of the cable 116 are supported in the aperture 100 in the planar member 98. Other portions of the cable are supported adjacent the upstanding member 52 in a guide and support member 124 coupled to the upstanding member by a brace 126. The other end 128 of the cable 116 is coupled to the mechanism 114 to rotate the shaft in a well known manner.

The power unit 110 of the trolling motor is also electrically powered to be activated in a well known manner by a battery (not shown) and a switch 142 (FIG. 2). The switch 142 is mounted on the longitudinally extending arm 74 of the L-shaped member 68 to be convenient to the occupant of the seat 24.

When it is desired to use the swivel chair stand and trolling motor control 10 an occupant (not shown) will first position the swivel chair stand 11 in a desired direction by rotating the stand. When the occupant needs to position or reposition the boat 12 the trolling motor 62 is activated by the switch 142 to electrically engage the power unit 110 of the trolling motor. Once the power unit is electrically engaged the position of the boat 12 can be changed in the water as desired by the occupant pivoting the hand held control arm 92 in a clockwise or counter clockwise direction (FIG. 5). Movement of the control arm 92 will cause the cable 116 to be moved forward or backwards depending on the direction of diagonal rotation of the control arm. This in turn rotates the shaft 112 and control unit 110 to move the bow of the boat 12 and thus control the direction of movement of the boat.

It should be understood that various changes and modifications can be made without departing from the spirit of the invention as defined in the following claims.

What is claimed:

1. A trolling motor assembly for controlling movement of a trolling motor mounted on a boat including:

a platform support member having an opening formed therein;

a seat coupled to an upper position of the platform support member;

means coupled to a lower portion of the platform support member for supporting the platform support member and seat in an upright position on the boat in alignment with and adjacent to the trolling motor;

a laterally extending arm having portions thereof coupled to one side of the seat;

a first longitudinally extending arm coupled to extend perpendicularly from the laterally extending arm;

a second longitudinally extending arm having upper portions thereof coupled to the first longitudinally extending arm;

a downwardly projecting arm coupled to extend perpendicularly from the second longitudinally extending arm;

a shaft rotatably coupled to the trolling motor; and means pivotally coupled to the second longitudinally extending arm for diagonal movement so that when moved diagonally in one direction the shaft coupled to the trolling motor rotates in one direction and thus the trolling motor is moved laterally in a first direction and so that when moved diagonally in another direction the shaft coupled to the trolling motor rotates in another direction and thus the trolling motor is moved in a second direction.

2. A trolling motor assembly as defined in claim 1 wherein the means pivotally coupled to the second longitudinally extending arm for diagonal movement includes:

an elongated control arm pivotally coupled to the second longitudinally extending arm for diagonal movement thereon; and a cable coupled at one end thereof to the control arm and at the other end thereof to the trolling motor so that when the control arm is moved diagonally in one direction the cable engages the trolling motor to move laterally in a first direction and so that when the control arm is moved diagonally in another direction the cable engages the trolling motor to move laterally in a second direction.

3. A trolling assembly as defined in claim 2 wherein the downwardly projecting arm further includes a planar support member having an opening formed herein, coupled to extend perpendicularly from lowermost portions of the downwardly projecting arm for receiving intermediate portions of the cable in the opening thereby supporting the cable therein.

4. A trolling motor assembly as defined in claim 3 wherein the platform support member further includes a storage compartment slidably mounted in the opening formed therein.

5. A trolling motor assembly as defined in claim 4 wherein the means for supporting the platform support member and seat includes:

a swivel support member having an opening formed therein, coupled to the platform support member;

a sleeve having an opening formed therein mounted in the opening in the swivel support member;

a plurality of ball bearing coupled for rotation in the sleeve; and an upstanding member having upper portions thereof supported in the opening in the swivel support member and the opening in the sleeve and lower portions thereof supported on the boat so that the swivel support member can be rotated thereon to rotate the platform support member and seat.

* * * * *